US008864186B2

(12) United States Patent
Kondratuk

(10) Patent No.: US 8,864,186 B2
(45) Date of Patent: Oct. 21, 2014

(54) GEAR LATCH-BOLT MECHANISM

(75) Inventor: Michael W. Kondratuk, Brookings, SD (US)

(73) Assignee: Larson Manufacturing Company, Brookings, SD (US)

( * ) Notice: Subject to any disclaimer, the term of this patent is extended or adjusted under 35 U.S.C. 154(b) by 489 days.

(21) Appl. No.: 12/260,838

(22) Filed: Oct. 29, 2008

(65) Prior Publication Data

US 2009/0113957 A1 May 7, 2009

Related U.S. Application Data

(60) Provisional application No. 60/983,442, filed on Oct. 29, 2007.

(51) Int. Cl.
*E05C 1/12* (2006.01)
*E05B 55/00* (2006.01)
*E05B 1/00* (2006.01)

(52) U.S. Cl.
CPC ..... *E05B 55/00* (2013.01); *E05B 2001/0076* (2013.01); *Y10S 292/52* (2013.01)
USPC ..... 292/165; 292/167; 292/169; 292/169.23; 292/DIG. 52

(58) Field of Classification Search
CPC ..... E05C 1/00; E05C 1/002; E05C 1/08; E05C 1/12; E05C 1/16; E05C 1/163; E05B 55/005
USPC ..... 292/169, 169.15, 169.16, 169.21, 139, 292/140, 143, 163–165, 167, 169.23, 292/DIG. 52, 1.5, 142, 160, 172, 279, 336.5
See application file for complete search history.

(56) References Cited

U.S. PATENT DOCUMENTS

| | | | | | |
|---|---|---|---|---|---|
| 1,831,067 | A * | 11/1931 | Hansen | 292/167 |
| 2,222,411 | A * | 11/1940 | Kaiser | 292/165 |
| 2,293,645 | A * | 8/1942 | Falk | 70/151 R |
| 2,401,559 | A * | 6/1946 | Falk | 292/165 |
| 2,673,758 | A * | 3/1954 | Schlage | 292/244 |
| 2,741,502 | A * | 4/1956 | Crandell | 292/169.23 |
| 2,770,480 | A * | 11/1956 | Linton | 292/169.13 |
| 2,988,389 | A * | 6/1961 | Wilson | 292/165 |
| 3,160,432 | A * | 12/1964 | Crepinsek | 292/167 |
| 3,175,376 | A * | 3/1965 | Cantwell | 70/131 |
| 4,974,883 | A * | 12/1990 | Jans | 292/169 |
| 5,020,836 | A * | 6/1991 | Su | 292/165 |
| 5,259,652 | A * | 11/1993 | Adams et al. | 292/169.14 |
| 5,342,101 | A * | 8/1994 | Shih | 292/165 |
| 5,647,617 | A * | 7/1997 | Kajuch | 292/1.5 |
| 5,690,372 | A * | 11/1997 | Jans | 292/169 |
| 6,526,787 | B2 * | 3/2003 | Ming-Chih | 70/107 |
| 6,536,248 | B1 | 3/2003 | Fan | 70/467 |
| 2007/0007773 | A1 * | 1/2007 | Berkseth et al. | 292/169 |

* cited by examiner

*Primary Examiner* — Kristina Fulton
*Assistant Examiner* — Alyson M Merlino
(74) *Attorney, Agent, or Firm* — Nawrocki, Rooney & Sivertson, P.A.

(57) ABSTRACT

A mortise lock for mounting in a door. The lock includes a bolt movable along a first axis between an extended position and a retracted position. Included are means for biasing the bolt to its extended position. The lock further includes a driven member which is mounted for rotation about a second axis generally perpendicular to the first axis. As the driven member is made to rotate about the second axis, it engages the bolt and urges it, overcoming the bias, to its second position. A drive member is mounted for rotation about a third axis, generally parallel to the second axis.

3 Claims, 7 Drawing Sheets

GEAR LATCH-BOLT MECHANISM

CROSS-REFERENCE TO RELATED APPLICATIONS

This is a regular application filed under 35 U.S.C. §111(a) claiming priority, under 35 U.S.C. §119(e)(1), of provisional application Ser. No. 60/983,442, previously filed Oct. 29, 2007 under 35 U.S.C. §111(b).

TECHNICAL FIELD

The present invention is a door mortise lock. The mechanism described is related to a latch used in a door to constrain it closed, when in an extended position, and allow door opening when in a retracted position.

BACKGROUND OF THE INVENTION

Latches carried by a door to effect secure locking are very common. They typically include a latch bolt enclosed within a housing. Many are rotationally actuated and bi-directional. This means they are actuated by either clockwise or counter-clockwise handle rotation. In a neutral or un-actuated position, the bolt is extended from the housing and precludes door opening when the bolt is engaged in a typical strike plate. Handle rotation retracts the latch bolt to disengage the bolt from the strike plate and allow the door to be opened. Typically, closing of the door imparts a force upon the bolt by the strike plate or door frame to retract the bolt without manual handle rotation being required.

Many latch mechanisms today rely on cams for actuation. This involves the generation of friction between cam body surfaces and creates wear under conditions of cyclical use. Additionally, some mechanisms require significant handle rotation (more than 45°) to retract the bolt within its housing. What is needed, therefore, is a latch mechanism which retracts the latch bolt with less than 45° rotation and eliminates frictional wear typically brought to bear upon sliding cam surfaces. The present invention offers solutions to these problems.

SUMMARY OF THE INVENTION

The present invention is a mortise lock which employs a gear latch bolt mechanism which includes at least one toothed member received in a latch-housing. A handle is mechanically coupled to a drive member for moving the bolt between an extended and a retracted position. The mechanism also includes a driven member, actuable by the drive member, which acts upon the bolt to move it from a first, extended position to a second, retracted position. Both the drive member and the driven member may employ involute gear profiles. As a result, rotation of the drive member imparts force to the driven member with only minimal frictional force at a location of engagement. The driven member then linearly retracts the bolt by means of a projection extending from the driven member into a receiver of the bolt.

The mechanism described can incorporate two sets of drive and driven members, which can be substantially identical to each other, to retract the bolt. Such a construction allows for bi-directional actuation (that is, either clockwise or counter-clockwise handle rotation) to retract the bolt. It will be understood that the handle rotational angle required to retract the bolt is a function of the geometry of the driven member related to the bolt.

The present invention is thus an improved mortise lock mechanism. More specific features and advantages obtained in view of those features will become apparent with reference to the Detailed Description of the Invention, appended claims and accompanying drawing figures.

DETAILED DESCRIPTION OF THE INVENTION

Figure 1:
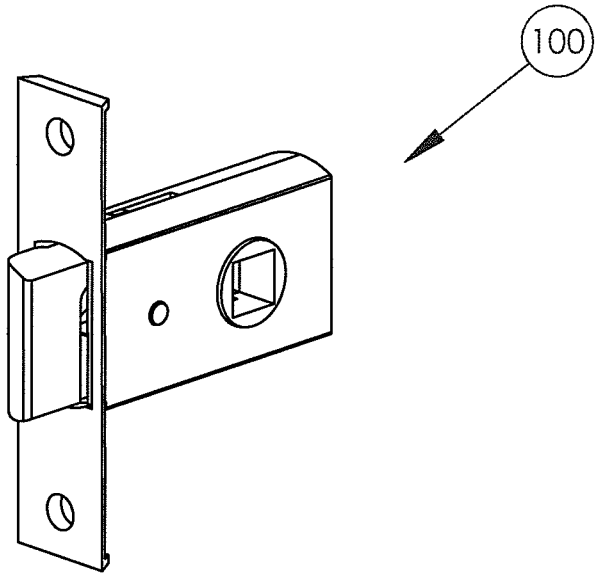
FIG. 1 is an isometric view of the present invention.
Figure 2:
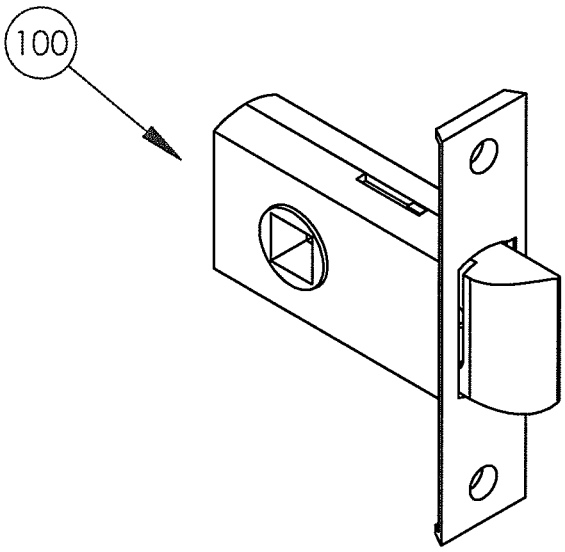
FIG. 2 is an alternate perspective view of the structure of FIG. 1.
Figure 3:
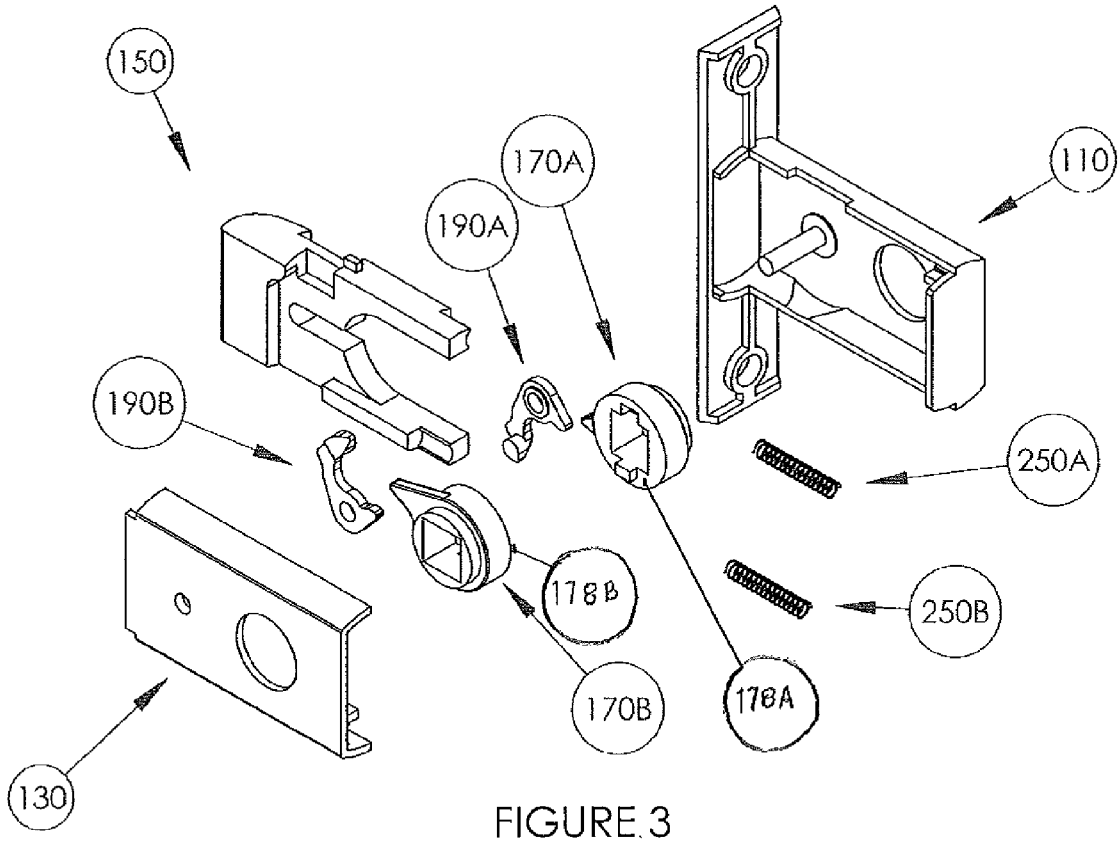
FIG. 3 is an exploded isometric view of the invention.
Figure 4:
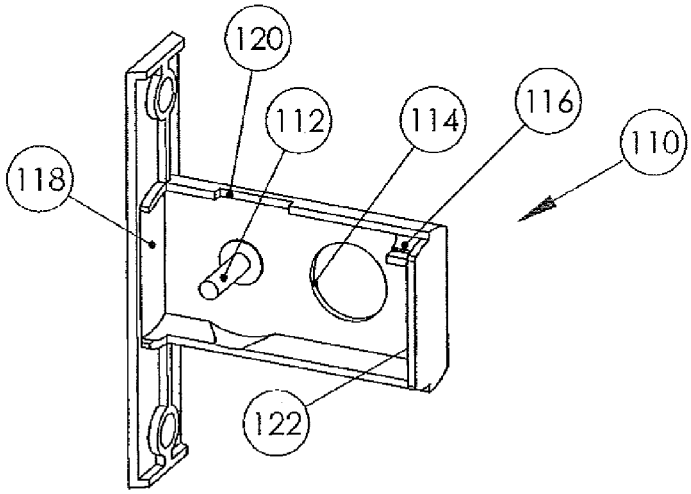
FIG. 4 is an isometric view of the mechanism housing.
Figure 5:
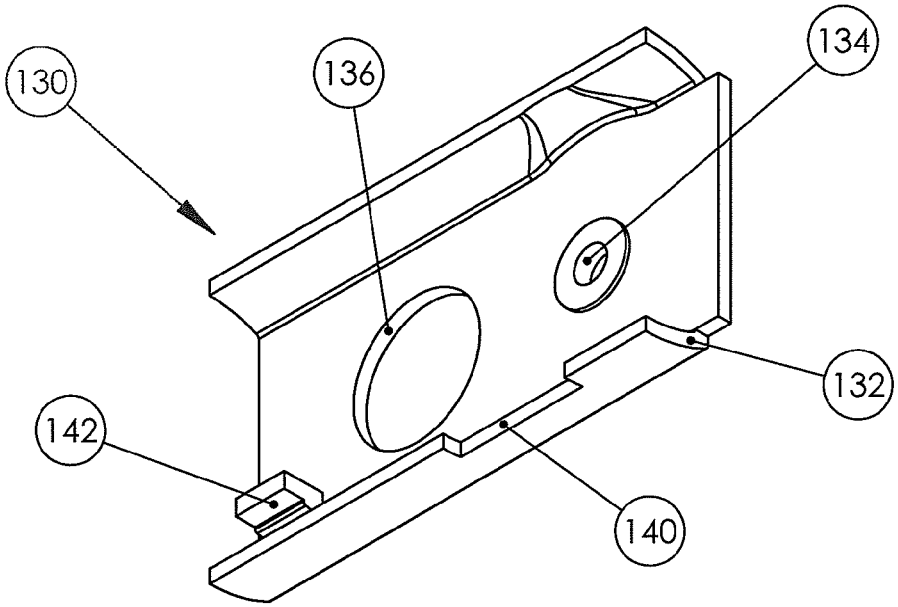
FIG. 5 is an isometric view of the mechanism cover.
Figure 6:
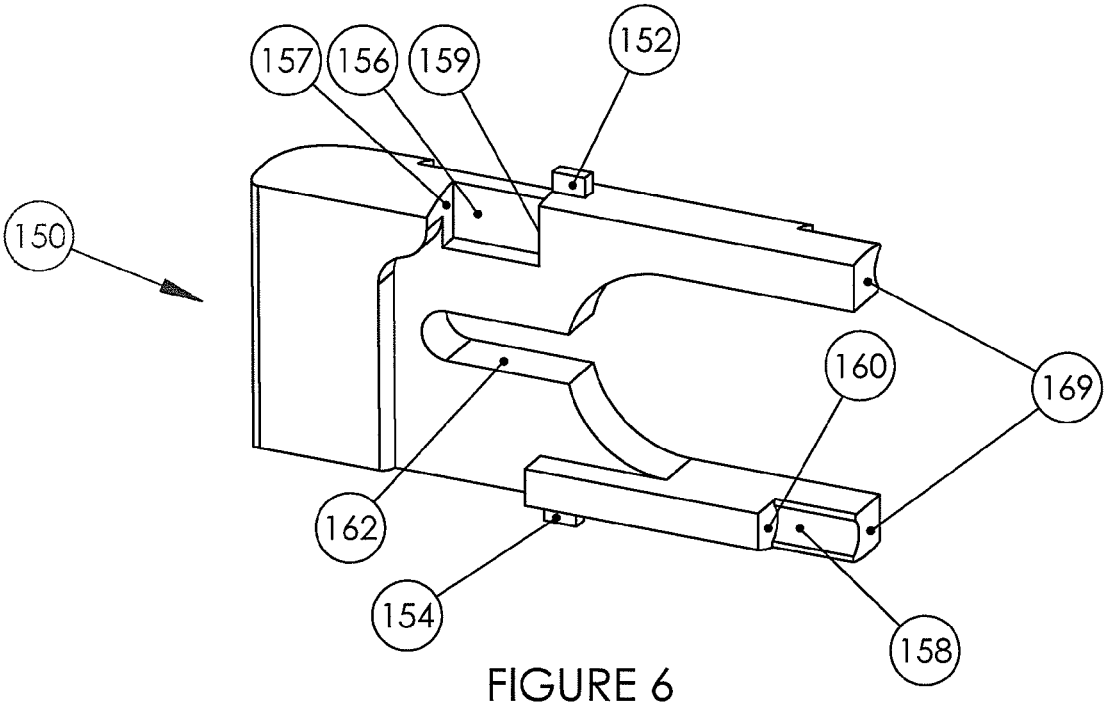
FIG. 6 is an isometric view of the mechanism bolt.
Figure 7:
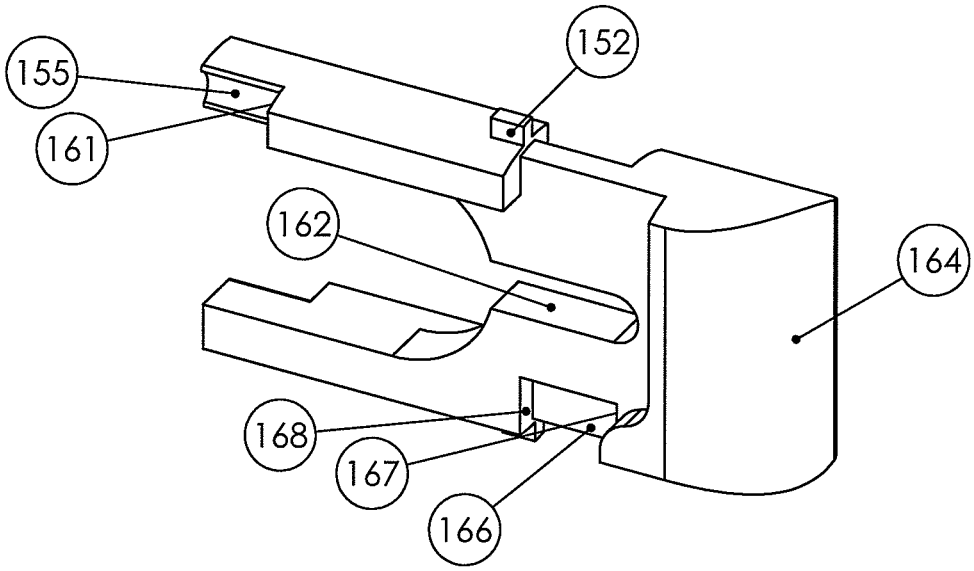
FIG. 7 is an alternate perspective view of the structure of FIG. 6.
Figure 8:
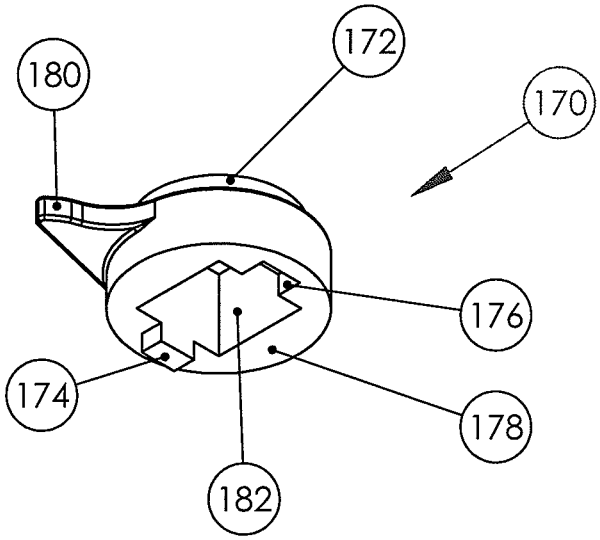
FIG. 8 is an isometric view of the mechanism drive member.
Figure 9:
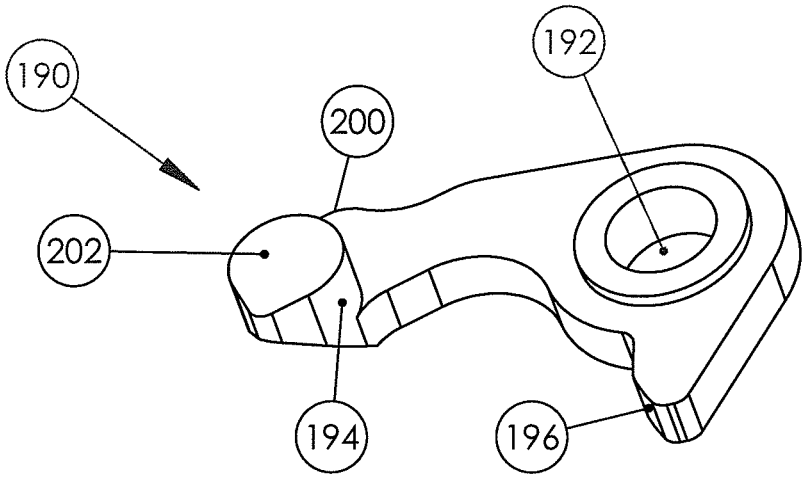
FIG. 9 is an isometric view of the mechanism driven member.

Referring to FIG. 3 and appended Component Description List, illustrated are the basic components of the present gear latch-bolt mechanism 100. Included are a housing 110, bolt springs 250A and 250B, two drive members 170 (170A and 170B individually), two driven members 190 (190A and 190B individually), a bolt 150 and a cover 130. It will be understood that a reference numeral without suffix A or B is intended to refer collectively to similar components, while, where suffix A or B is used, the intent is to refer to only one of the components individually.

The latch assembly is more specifically described referring to FIGS. 3-9. A drive member 170A has a drive bearing 172 which is inserted in the housing 110 opening 114, shown in FIG. 4, and positioned with the drive tooth 180 oriented extending toward the bolt opening 118. The driven member 190 post receiver 192 is positioned over the housing post 112 such that the roll post 202 is positioned similar to the orientation shown in FIG. 3 for driven member 190A. The bolt wear surface 164 is fed into the housing bolt opening 118 and placed such that the roll post 202 of the driven member is received within the peg receiver 166. The identical drive member 170B is then positioned over the first drive member 170A such that the alignment guide 174 from the drive member 170B aligns with the alignment receiver 176 of the drive member 170A. It will be understood that the alignment guide 174 would align with the alignment receiver 176 of the drive member 170B. The drive members are then in engagement with the respective planar surfaces 178A and 178B touching. The interlocking feature eases spindle insertion but is not required for latch functionality. The second driven member 190B which is substantially identical to driven member 190A is then positioned by aligning the post receiver 192 with the post 112 such that the roll post 202 of driven member 190B is received within the peg receiver 156 of the bolt. It will be understood that the length of peg receiver 156 along its axis and the length of the upper extending portion of driven member 90B are such that the driven member extension will always remain captured in peg receiver 156 so as to preclude a lockout situation. The two identical bolt springs 250 are then inserted such that they are linearly constrained by the bolt spring supports 160 and 161, and the spring guides 155 and 158 and the spring receiver 116 of the housing and the spring receiver 142 of the cover 130. It should be understood that the bolt springs exert a force upon the bolt that biases the bolt toward an extended position. The cover 130 bolt end 132 is then inserted in the bolt opening 118, and the cover post opening 134 is positioned over the post 112 in conjunction with the drive bearing 172 of the drive member 170B being positioned within the gear opening 136 of the cover. The post 112 is then deformed to constrain the cover 130 to the housing 110 encapsulating the latch components.

Figure 10:
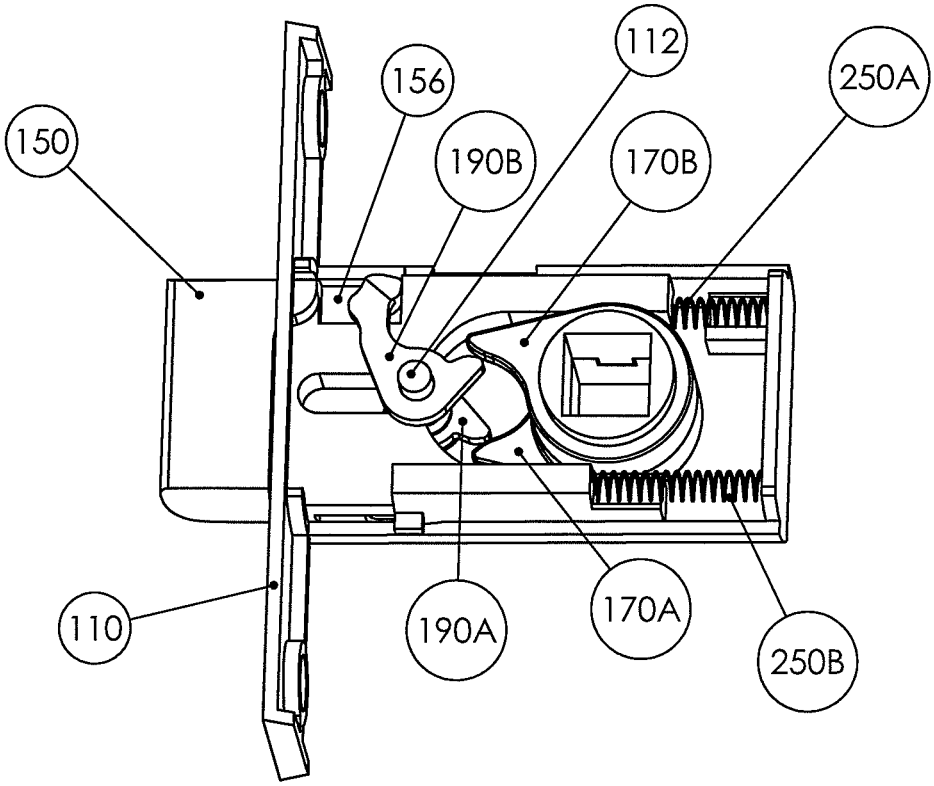
FIG. 10 is a perspective view of the mechanism with the bolt extended and the cover removed.
Figure 13:
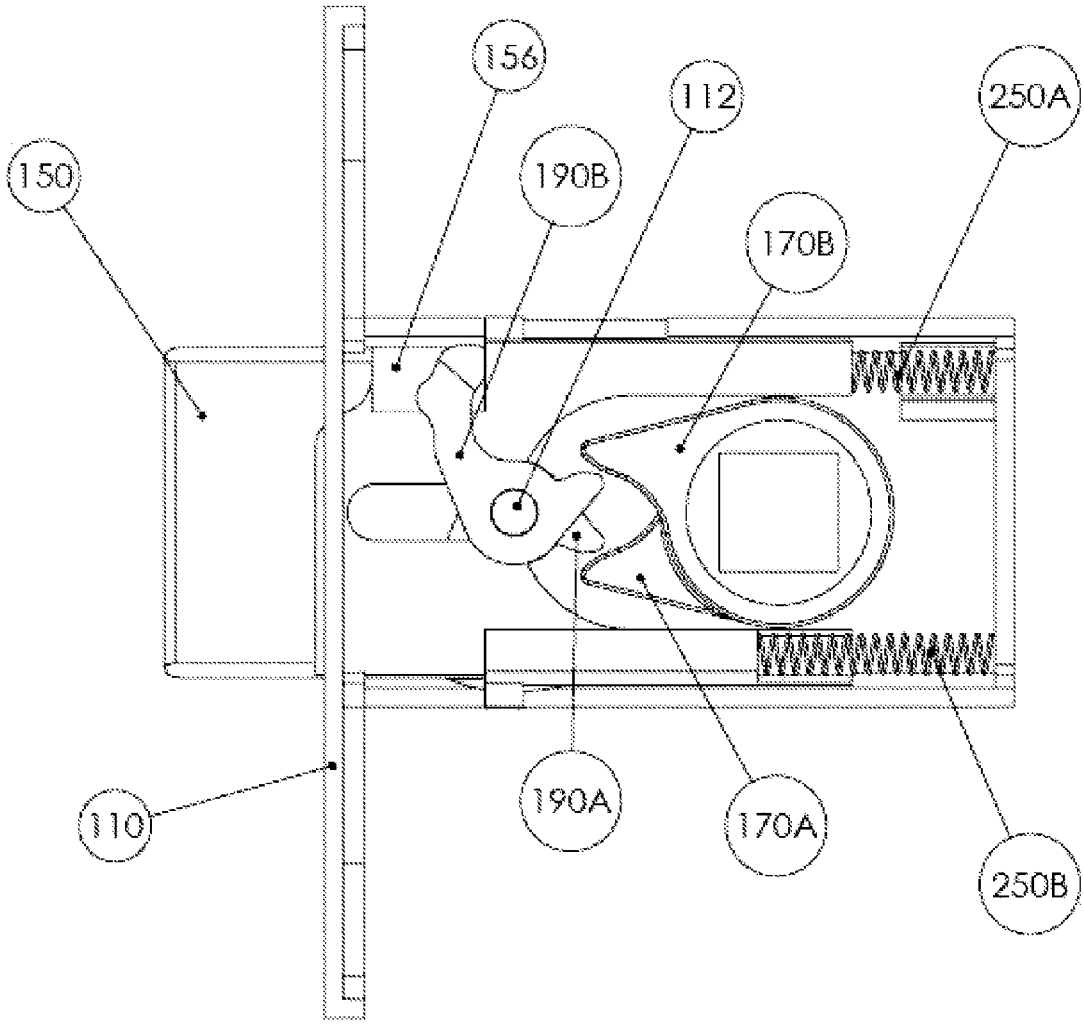
FIG. 13 is a straight-on side elevational view of the mechanism with the bolt extended and the cover removed.

The discussion above applies to FIG. 13 as well as to FIG. 10. FIG. 10 better shows the gap, however, between each drive member and a corresponding driven member, FIG. 13 being straight on.

The function of the latch is described below. The cover is not shown in FIGS. 10-12 to allow understanding of internal component interaction. Referring to FIG. 10, the latch is shown in the neutral or un-actuated position in which the bolt is in an extended position relative to the housing. In this position, the compression springs are shown in a pre-loaded, but extended position. The drive members are in a neutral position. The driven members are in a float position and are rotationally limited by the drive member and bolt peg receiver geometry. The bolt is restricted from extending further due to the interaction of the housing bolt stop 152 and the cover bolt stop 154 with the housing stop guide 120 and cover stop guide 140.

Figure 11:
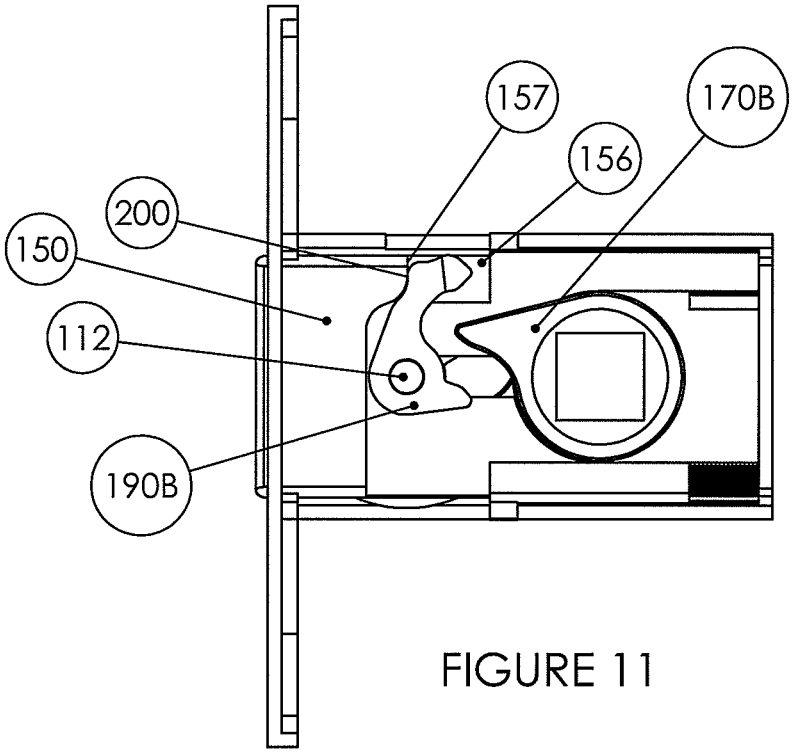
FIG. 11 is a side view of the mechanism with the bolt retracted and the cover removed.

FIG. 11 depicts the latch with the bolt retracted by means other than the rotation of a handle. Such retraction can result as from a door closing and the attendant bolt and strike or door frame interaction. As shown in FIG. 11, the drive members may remain in a neutral position, but the driven members are rotated as a result of interaction of the bolt outer surface 157 and 167 and the roll surface 200 of both driven members 190A and 190B. As shown in FIG. 11, the driven member 190B is rotated away from the drive member 170B which remains in the neutral position. The bolt may be limited in retraction by the interaction of the housing and cover bolt stops. Also, the contact of the bolt rear stop 169 with the housing rear wall 122.

Figure 12:
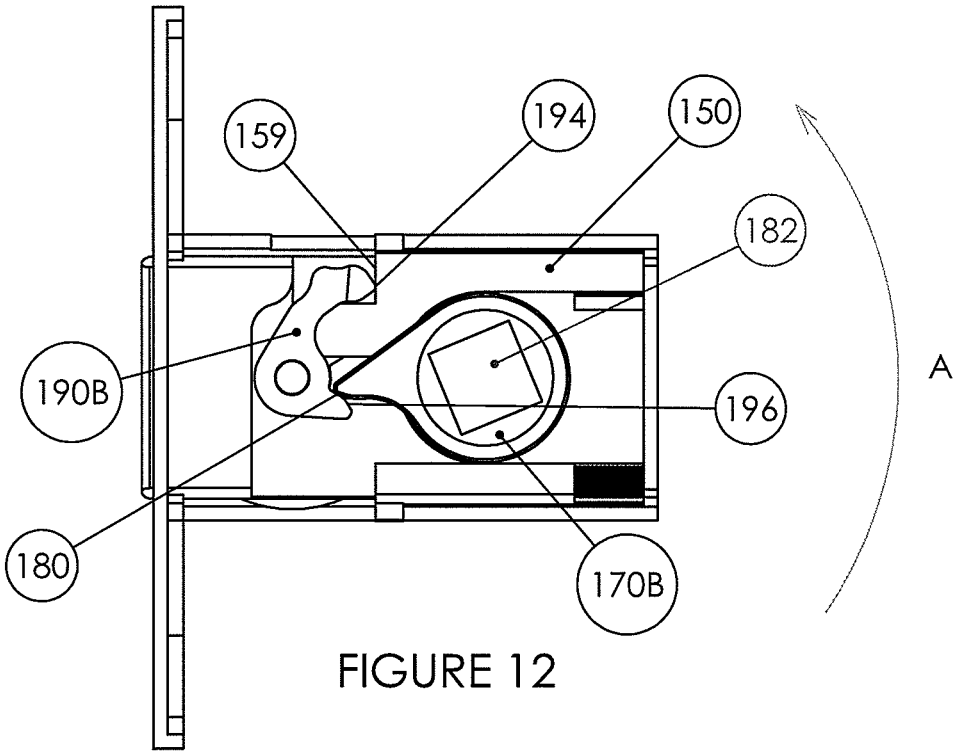
FIG. 12 is a side view of the mechanism with the bolt retracted as a result of driven member rotation, and the cover removed.

Referring to FIG. 12, the latch is shown with the bolt retracted by means of the driven member rotation in a counter-clockwise direction. This is typically accomplished by means of a handle with a spindle attachment insertable through the spindle receiver 182 of the drive member. In this figure it is seen that the tooth of the drive member interacts with the driven member, and the roll guide 194 engages the inner surface 159 and retracts the bolt within the latch. This causes the bolt springs to be compressed such that, when the rotational force on the drive member is released, the bolt is again biased to an extended position. The functioning of the latch is similar for clockwise handle rotation as viewed in FIG. 12. The difference is that the acting drive member is 170A and driven member is 190A rather than 170B and 190B as with counter-clockwise actuation. It has been found that it is efficient to maintain the angle through which a driven member is rotated small, typically less than 45 degrees and even less than 22 degrees.

It will be understood that the driven member, irrespective of which force transmission train is operative, functions as a first-class lever. That is, forces applied to an extension of the driven member by the corresponding drive member extending on a side of the axis of rotation of the driven member opposite that at which a second extension of the driven member engages the bolt within its receiver. This is in contrast to prior art devices. Consequently, the present invention achieves a high level of efficiency.

| Component | Feature | Description |
|---|---|---|
| 100 | | Gear Latch-Bolt Mechanism |
| 110 | | Housing |
| | 112 | Post |
| | 114 | Gear opening |
| | 116 | Spring receiver |
| | 118 | Bolt opening |
| | 120 | Stop guide |
| | 122 | Rear wall |
| 130 | | Cover |
| | 132 | Bolt end |
| | 134 | Post opening |
| | 136 | Gear opening |
| | 140 | Stop guide |
| | 142 | Spring receiver |
| 150 | | Bolt |
| | 152 | Housing bolt stop |
| | 154 | Cover bolt stop |
| | 155 | Spring guide |
| | 156 | Peg receiver |
| | 157 | Outer surface |
| | 158 | Spring guide |
| | 159 | Inner Surface |
| | 160 | Spring support |
| | 161 | Spring support |
| | 164 | Bolt wear surface |
| | 166 | Peg receiver |
| | 167 | Outer surface |
| | 168 | Inner surface |
| | 169 | Rear stop |
| 170 (A&B) | | Drive Member, Housing Side |
| | 172 | Drive bearing |
| | 174 | Alignment guide |
| | 176 | Alignment receiver |
| | 178 | Planar surface |
| | 180 | Drive tooth |
| | 182 | Spindle receiver |
| 190 (A&B) | | Driven Member |
| | 192 | Post receiver |
| | 194 | Roll guide |
| | 196 | Driven tooth |
| | 200 | Roll surface |
| | 202 | Roll post |
| 250 (A&B) | | Bolt Spring |

It will be understood that this disclosure, in many respects, is only illustrative. Changes may be made in details, particularly in matters of shape, size, material, and arrangement of parts without exceeding the scope of the invention. Accordingly, the scope of the invention is as defined in the language of the appended claims.

What is claimed is:

1. A mortise lock for mounting in a door, comprising:

(a) a bolt movable along a first axis between a first, extended position and a second, retracted position, said bolt having an end, wherein, when said bolt is in said first, extended position thereof and when the door is rotated to a closed position, said end engages a strike or door frame which urges said bolt toward said second, retracted position;

(b) means for biasing said bolt to said first, extended position;

(c) a first driven member mounted for rotation about a second axis, generally perpendicular to said first axis, to engage said bolt and urge it, against biasing of said biasing means, to said second, retracted position;

(d) a first drive member mounted for rotation about a third axis, generally parallel to said second axis, between a neutral position in which a tooth extending from said first drive member does not engage a tooth extending from said first driven member nor initiate rotation of said first driven member, and a rotated position in which said tooth extending from said first drive member engages said tooth extending from said first driven member and rotates said first driven member into engagement with said bolt to urge said bolt to said second, retracted position thereof;

(e) a second driven member, coaxial with said first driven member, mounted for rotation about said second axis, independently of rotation of said first driven member about said second axis, and offset from said first driven member along said second axis shared with first driven member, to engage said bolt and urge it, against biasing of said biasing means, from said first, extended position to said second, retracted position when rotated in a direction opposite to that of said first driven member when engaging said bolt; and (f) a second drive member mounted for rotation about said third axis, between a neutral position in which a tooth extending from said second drive member does not engage a tooth extending from said second driven member nor initiate rotation of said second driven member, and a rotated position in which said tooth extending from said second drive member engages said tooth extending from said second driven member and rotates said second driven member into engagement with said bolt to urge said bolt to said second, retracted position thereof.

2. The mortise lock of claim 1 wherein each of said teeth extending from said drive members and corresponding driven members comprise an angular section of an involute gear profile arranged such that rotation of said drive members can effect engagement and rotation of corresponding of said driven members without sliding or slippage between said teeth extending from each driven member and corresponding drive member.

3. The mortise lock of claim 1 wherein each of said first drive member and said first driven member has a portion of an involute gear profile arranged such that rotation of said first drive member can engage and rotate said first driven member, and wherein each of said second drive member and said second driven member has a portion of an involute gear profile arranged such that rotation of said second drive member can engage and rotate said second driven member.

* * * * *